US010279206B2

(12) United States Patent
Kono et al.

(10) Patent No.: US 10,279,206 B2
(45) Date of Patent: May 7, 2019

(54) FIRE EXTINGUISHING SYSTEM OF AIRCRAFT, AND AIRCRAFT

(71) Applicant: MITSUBISHI AIRCRAFT CORPORATION, Aichi (JP)

(72) Inventors: Takafumi Kono, Aichi (JP); Takashi Shimaoka, Aichi (JP); Mitsunori Ehara, Aichi (JP); Koichiro Fushiya, Aichi (JP)

(73) Assignee: MITSUBISHI AIRCRAFT CORPORATION, Aichi (JP)

( * ) Notice: Subject to any disclaimer, the term of this patent is extended or adjusted under 35 U.S.C. 154(b) by 445 days.

(21) Appl. No.: 14/583,945

(22) Filed: Dec. 29, 2014

(65) Prior Publication Data

US 2015/0202477 A1 Jul. 23, 2015

(30) Foreign Application Priority Data

Jan. 17, 2014 (JP) ..... 2014-006646

(51) Int. Cl.

| | |
|---|---|
| ***A62C 3/08*** | (2006.01) |
| ***A62C 31/02*** | (2006.01) |
| ***A62C 31/28*** | (2006.01) |
| *A62C 35/68* | (2006.01) |

(52) U.S. Cl.

CPC ..... *A62C 3/08* (2013.01); *A62C 31/02* (2013.01); *A62C 31/28* (2013.01); *A62C 35/68* (2013.01)

(58) Field of Classification Search

CPC ..... A62C 3/002; A62C 3/08; A62C 31/02; A62C 31/22; A62C 35/68; B05B 15/001; B05B 15/061

See application file for complete search history.

(56) References Cited

U.S. PATENT DOCUMENTS

| | | | | | |
|---|---|---|---|---|---|
| 3,540,438 | A * | 11/1970 | Jacuzzi | A61H 33/027 | 4/541.4 |
| 4,562,964 | A * | 1/1986 | Diamond | A61H 33/027 | 126/317 |
| 5,469,147 | A * | 11/1995 | Trey | A62C 3/08 | 340/628 |
| 2012/0255746 | A1* | 10/2012 | Johnsen | A62C 35/68 | 169/62 |

* cited by examiner

*Primary Examiner* — Ryan A Weis
(74) *Attorney, Agent, or Firm* — Pearne & Gordon LLP

(57) ABSTRACT

A fire extinguishing system of an aircraft including a nozzle device that is provided on an installation member forming a compartment of the aircraft, wherein the nozzle device includes: a nozzle that is passed into an insertion hole formed in a nozzle installation section provided on the installation member, and discharges a fire extinguishing agent supplied from a supply source into the aircraft compartment; and a lid member that closes a gap between the nozzle and the nozzle installation section.

20 Claims, 5 Drawing Sheets

FIRE EXTINGUISHING SYSTEM OF AIRCRAFT, AND AIRCRAFT

BACKGROUND OF THE INVENTION

Field of the Invention

The present invention relates to a fire extinguishing system that discharges a fire extinguishing agent from a nozzle provided on a ceiling or a wall that forms a compartment of an aircraft, and an aircraft including the fire extinguishing system.

Description of the Related Art

A cargo hold, an engine compartment, an auxiliary power unit compartment or the like of aircraft are provided with a fire extinguishing system that injects a fire extinguishing agent from a nozzle device installed on an installation member (liner) forming a compartment in preparation for a fire (U.S. Patent Application Publication No. 2012/0255746).

For example, a halon compound is injected as the fire extinguishing agent. When the density of halon in the compartment is increased, a combustion chain reaction is inhibited by the negative catalysis of the halon. Thus, a fire is extinguished.

The nozzle device includes a pan that is installed on the installation member, and a fire extinguishing nozzle that is connected to a pipe provided on a fuselage structure on the back side of the installation member.

The fire extinguishing nozzle is passed through an insertion hole of the pan, and fixed to the pan with a bolt or the like. Alternatively, the fire extinguishing nozzle and the pan are machined into an integrated body.

When the fire extinguishing nozzle passed through the insertion hole of the pan is fixed to the pan with a bolt or the like, or when the fire extinguishing nozzle and the pan are integrally formed, no gap is generated between the fire extinguishing nozzle and the pan. Therefore, the halon injected into the compartment can be kept in the compartment without leaking from the gap.

However, when the fire extinguishing nozzle and the pan are fixed with a bolt or the like or integrally formed as described above, the fire extinguishing nozzle and the pan are rigidly coupled together without allowing relative displacement. In this case, an excessive load is input to the nozzle via the installation member and the pan if an article brought into the compartment explodes and a wind pressure generated from the explosion is applied to the installation member.

Thus, an object of the present invention is to provide a fire extinguishing system of an aircraft capable of securing a fire extinguishing function without causing damage to a fire extinguishing nozzle upon receiving an excessive load from an explosion or the like, and an aircraft including the fire extinguishing system.

SUMMARY OF THE INVENTION

The present invention is a fire extinguishing system of an aircraft including a nozzle device that is provided on an installation member forming a compartment of an aircraft, wherein the nozzle device includes: a nozzle that is passed into an insertion hole formed in a nozzle installation section provided on the installation member, and discharges a fire extinguishing agent supplied from a supply source into the compartment; and a lid member that closes a gap between the nozzle and the nozzle installation section.

In accordance with the present invention, since the gap between the nozzle and the nozzle installation section is closed with the lid member, the fire extinguishing agent discharged from the nozzle is kept in the compartment without leaking from the gap. Therefore, the density of the fire extinguishing agent in the compartment is increased to a required density, and a fire is extinguished.

In the present invention, the gap exists between the nozzle and the nozzle installation section, and the gap is only closed with the lid member. Thus, the nozzle and the nozzle installation section are not rigidly coupled together.

Therefore, when an impact load from a blast or the like is applied to the installation member, the nozzle installation section is relatively displaced with respect to the nozzle, so that an excessive load is not input to the nozzle.

Consequently, damage to the nozzle is prevented, and a fire extinguishing function of the fire extinguishing system can be secured even after an explosion.

"Close" in the present invention does not necessarily mean that the gap is hermetically closed. Therefore, even a lid member where a small hole or opening is formed can be used as the lid member in the present invention.

Also, "Discharge" in the present invention includes "inject".

In the fire extinguishing system of the present invention, the lid member may be fixed to one of the nozzle installation section and the nozzle, and the nozzle installation section is preferably displaced with respect to the nozzle by a load exceeding a frictional force between the other of the nozzle installation section and the nozzle, and the lid member.

By causing relative displacement between one of the nozzle installation section and the nozzle and the lid member fixed to the one, and the other of the nozzle installation section and the nozzle as described above, a relative displacement amount between the nozzle installation section and the nozzle can be ensured even when the lid member itself is not provided with a large displacement amount.

Therefore, the lid member having a small and simple form that only closes the gap between the nozzle and the nozzle installation section can be used without using a lid member having a large and complicated form with a large displacement amount. Consequently, the weight and the cost of the nozzle device can be suppressed.

In the fire extinguishing system of the present invention, the lid member preferably has flexibility.

Since the lid member can be pressed against the nozzle and the nozzle installation section by the flexibility of the lid member, the gap between the nozzle and the nozzle installation section can be hermetically closed. Accordingly, the density of the fire extinguishing agent in the compartment is rapidly increased, and a fire can be smoothly extinguished.

In the fire extinguishing system of the present invention, the lid member preferably includes a lip portion having a holding hole into which the nozzle is inserted, and a flange portion that is fixed around the insertion hole.

Accordingly, the outer periphery of the nozzle can be tightened by the lip portion of the lid member having flexibility, so that the gap can be hermetically closed.

Also, the lid member can be easily fixed to the nozzle installation section by the flange portion.

In the fire extinguishing system of the present invention, the lid member is preferably formed of a composite material containing a rubber-based material having flexibility, and a fiber base material having higher fire resistance than the rubber-based material.

Accordingly, even when the rubber-based material is melted by the heat of a fire, the fiber base material remains. Thus, the fire extinguishing agent can be prevented from leaking from the gap. The lid member also contributes to prevention of a fire breakthrough from the gap.

In the fire extinguishing system of the present invention, it is preferable that the lid member is formed of a material containing a rubber-based material having flexibility, and incorporates a backup member having flexibility that is formed of a material having higher fire resistance than the rubber-based material, and the backup member is formed in a ring shape or a C shape along an outer periphery of the nozzle.

Accordingly, even when the rubber-based material or the like contained in the main material of the lid member is melted by the heat of a fire, the flexibility of the lid member can be secured by the backup member.

Examples of the backup member include a spring and a mesh.

In the fire extinguishing system of the present invention, it is preferable that the lid member is formed of a material containing a rubber-based material having flexibility, and incorporates a backup member having flexibility that is formed of a material having higher fire resistance than the rubber-based material, and the backup member is arranged at a position at least corresponding to the gap.

Accordingly, the backup member remaining after the rubber-based material is melted can prevent the leak of the fire extinguishing agent from the gap, and also contributes to prevention of a fire breakthrough from the gap.

In the fire extinguishing system of the present invention, the nozzle installation section is preferably a fixture that is integrated with the installation member.

A pan that surrounds the distal end side of the nozzle can be used as the fixture.

An aircraft of the present invention includes the above fire extinguishing system.

Here, the above fire extinguishing system may be used for extinguishing a fire in any compartment formed in the aircraft.

Particularly, the fire extinguishing system is preferably used for extinguishing a fire in a cargo hold that is a compartment into which an explosive is likely to be brought under the cover of cargo.

In accordance with the present invention, even when a pressure from an explosion or the like is applied to the installation member, an excessive load is not input to the fire extinguishing nozzle via the installation member, and the fire extinguishing function can be secured.

BRIEF DESCRIPTION OF THE DRAWINGS

FIG. 1A is a side view; and FIG. 1B is a perspective view;

DETAILED DESCRIPTION OF THE PREFERRED EMBODIMENTS

In the following, an embodiment of the present invention is described by reference to the accompanying drawings.

In the present embodiment, a fire extinguishing system that extinguishes a fire in a cargo hold (cargo room) of an aircraft is described as an example.

Figure 1A:
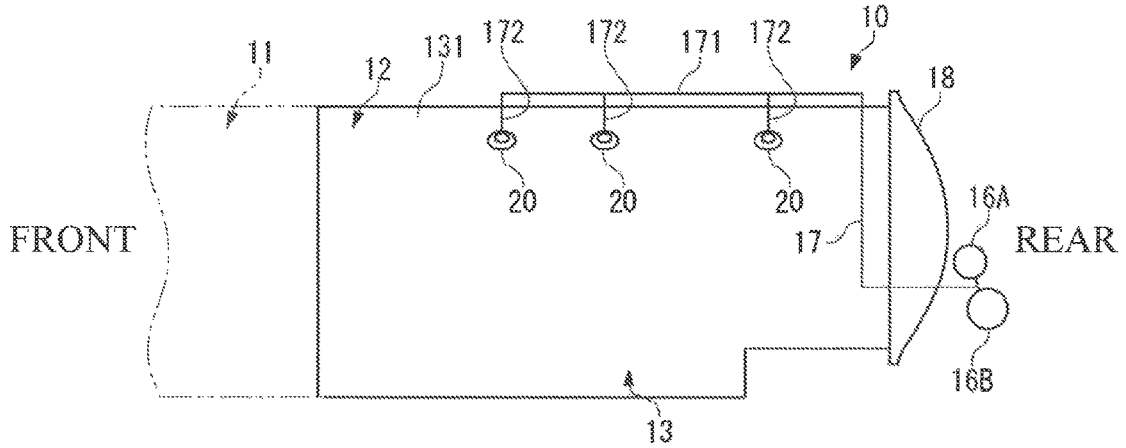
FIGS. 1A and 1B show a cargo hold of an aircraft where a fire extinguishing system according to an embodiment of the present invention is provided.

In an aircraft of the present embodiment, a cargo hold 12 is arranged behind a cabin 11 as shown in FIG. 1A. The cargo hold 12 corresponds to a rear end-side portion of a cylindrical fuselage.

Figure 1B:
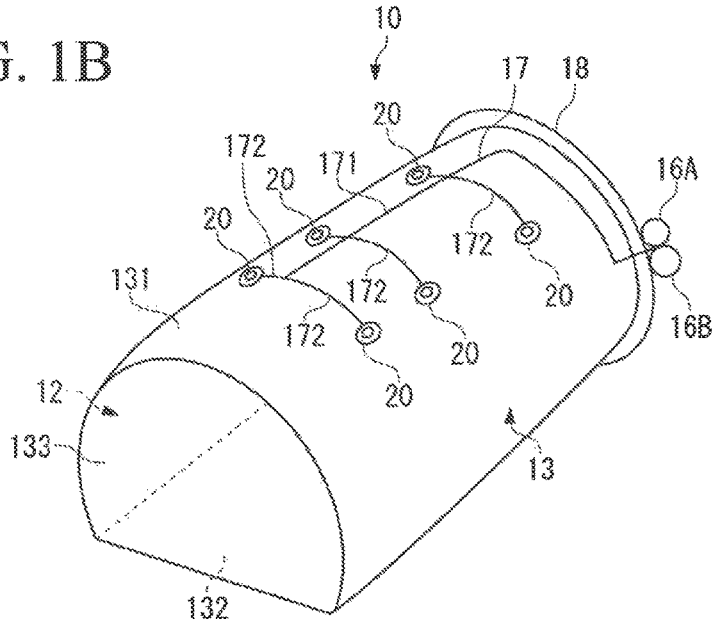

A liner 13 that is provided within a skin and a skeleton (a frame and a stringer) (not shown) of the fuselage is shown in FIGS. 1A and 1B. The liner 13 forms an indoor space (compartment) of the cargo hold 12.

As shown FIG. 1B, the liner 13 includes a liner 131 for a wall and a ceiling continuously provided in an arc shape, a liner 132 for a floor formed in a flat shape, a linear 133 forming a wall surface on the front side, and a liner (not shown) forming a wall surface on the rear side. A pipe, a wire or the like are provided between the floor liner 132 and the skin.

The liners are formed of a material having predetermined fire resistance. The liners of the present embodiment are formed of glass fiber reinforced plastics (GFRP) containing glass fiber.

A fire extinguishing system 10 that extinguishes a fire in the cargo hold 12 includes a high-pressure tank 16A and a low-pressure tank 16B that serve as a source for supplying a fire extinguishing agent, a fire extinguishing pipe 17 that is connected to the tanks 16A and 16B, and a plurality of nozzle devices 20 to which the fire extinguishing agent is supplied through the fire extinguishing pipe 17.

A halon fire extinguishing agent such as Halon 1301, Halon 1211, and Halon 2402, a hydrofluorocarbon fire extinguishing agent such as HFC-227ea and HFC-23, or the like is enclosed in the high-pressure tank 16A and the low-pressure tank 16B. The fire extinguishing agent in the high-pressure tank 16A has a higher pressure than the fire extinguishing agent in the low-pressure tank 16B. The high-pressure tank 16A is used for rapidly supplying the fire extinguishing agent so as to extinguish a fire in an early stage. The low-pressure tank 16B is used for continuously supplying the fire extinguishing agent for a longer time than that of the high-pressure tank 16A so as to complete fire extinction.

The tanks 16A and 16B are installed between a firewall 18 located behind the cargo hold 12, and an aft pressure bulkhead (not shown) provided behind the firewall 18.

The fire extinguishing pipe 17 includes a main pipe 171 that passes along the outer periphery of the liner 131 and extends to the front side from the position of the tanks 16A and 16B, and a branch pipe 172 that branches from the main pipe 171 toward the nozzle devices 20.

The main pipe 171 and the branch pipe 172 are fixed to the frame or the stringer of the fuselage with a bracket and a clamp (not shown).

Although the main pipe 171 and the branch pipe 172 are bent in portions interfering with the frame or the stringer, the main pipe 171 and the branch pipe 172 are shown in a simplified form.

The number of the nozzle devices 20 is six in the present embodiment. In a ceiling portion of the liner 131, the nozzle devices 20 are arranged at predetermined intervals.

Figure 2:
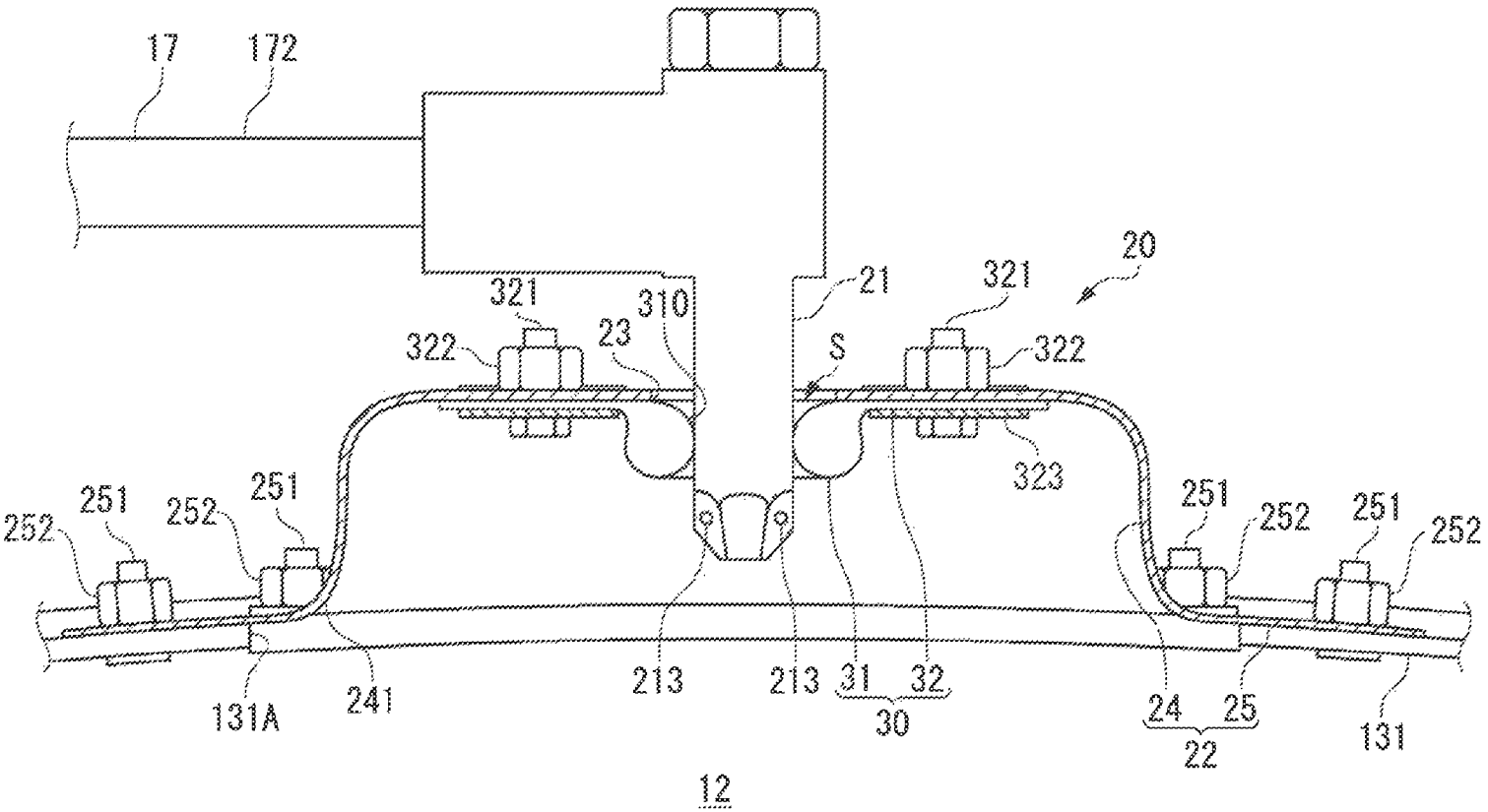
FIG. 2 is a sectional view illustrating a nozzle device of the fire extinguishing system.

As shown in FIG. 2, each of the nozzle devices 20 includes a nozzle 21 that injects the fire extinguishing agent, a pan 22 (a nozzle installation section, a fixture) to which the nozzle 21 is attached, and a lid member 30 that closes a gap S between the nozzle 21 and the pan 22.

The nozzle 21 injects the fire extinguishing agent into the cargo hold 12 via a circular opening 131A formed in the liner 131.

The fire extinguishing agent may be also injected from a cutout formed in an end portion of the liner or a gap between the liners instead of the opening 131A.

The nozzle 21 is connected perpendicularly to the branch pipe 172 of the fire extinguishing pipe 17. A plurality of injection holes 213 are formed in a distal end portion of the nozzle 21 at circumferential intervals.

The nozzle 21 and the pan 22 are formed of a metal material, such as stainless steel, having predetermined heat resistance and fire resistance. The lid member 30 is also formed of a material having predetermined heat resistance and fire resistance as described below.

The pan 22 includes a pan body 24 having an opening 241 corresponding to the opening 131A of the liner 131, and a peripheral edge portion 25 that is provided continuously from the outer periphery of the pan body 24.

The pan 22 is arranged so as to be laid face down on the back side of the liner 131 around the opening 131A.

The pan body 24 has an insertion hole 23 for passing the nozzle 21, and surrounds a portion of the nozzle 21 projecting from the insertion hole 23. An opening diameter of the insertion hole 23 is set to be larger than an outer diameter of the nozzle 21 so as to pass the nozzle 21 through the insertion hole 23. Therefore, the gap S is generated between the nozzle 21 and the pan 22.

The peripheral edge portion 25 is fastened to the liner 131 with bolts 251 and nuts 252 that are arranged at a plurality of circumferential positions. Accordingly, the pan 22 is fixed to the liner 131.

The lid member 30 closes the gap S between the outer periphery of the nozzle 21 and the inner periphery of the insertion hole 23 from below.

The lid member 30 includes a lip portion 31 that is located on the inner peripheral side, and a flange portion 32 that is located on the outer peripheral side.

The lip portion 31 is arranged at a position corresponding to the gap S. The lip portion 31 is arranged on the inner side of the pan body 24, and exists over an entire range where the gap S is projected from above. An outer diameter of the lip portion 31 is one size larger than the diameter of the insertion hole 23.

A holding hole 310 into which the nozzle 21 is inserted is formed in the center of the lip portion 31.

The lip portion 31 is formed thicker than the flange portion 32. The lip portion 31 holds the outer periphery of the nozzle 21 over the entire thickness.

Figure 3A:
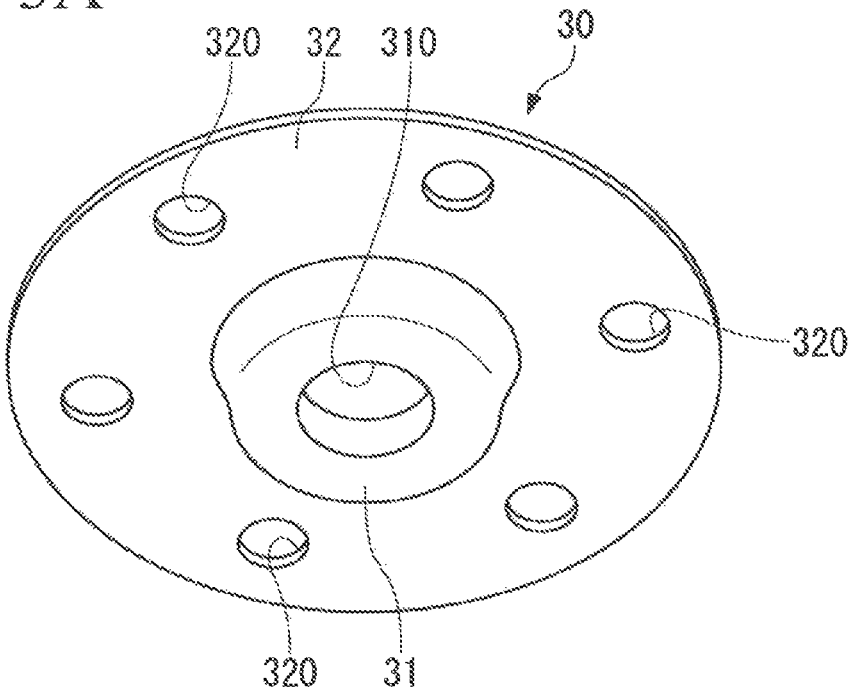
FIG. 3A is a perspective view illustrating a lid member.
Figure 3B:
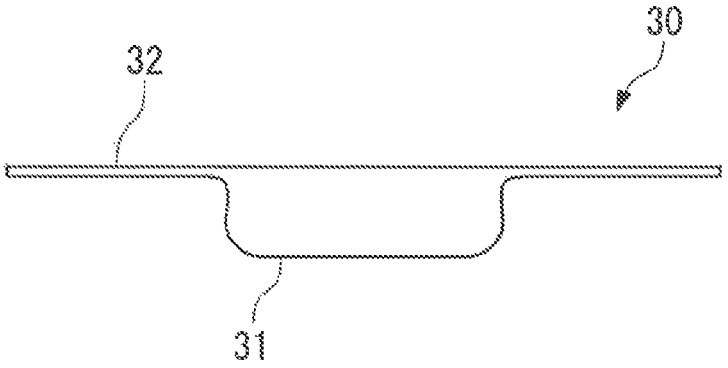
FIG. 3B is a side view illustrating the lid member.

As shown in FIGS. 3A and 3B, the flange portion 32 is provided continuously from the peripheral edge of the lip portion 31. The flange portion 32 is fixed to the inner side of the pan body 24 around the insertion hole 23 with bolts 321 inserted into holes 320 (FIG. 3A) formed at a plurality of positions around the insertion hole 23, and nuts 322. A ring-shaped retainer 323 is preferably overlapped on the lower side of the flange portion 32 along a circumferential direction of the flange portion 32. The flange portion 32 is sufficiently pressed against the pan body 24 over the entire circumferential direction by the retainer 323. A washer may be also provided on each of the bolts 321 instead of the ring-shaped retainer.

The lid member 30 preferably has flexibility so as to seal the gap S.

For example, a composite material obtained by impregnating or applying a rubber-based material into a fiber base material that is formed minutely from fiber of ceramics (including glass) or the like can be used as the lid member 30. Alternatively, a composite material obtained by laminating a plate formed of a rubber-based material, and a fiber base material may be also used.

The fiber base material gives fire resistance to the lid member 30, and the rubber-based material gives flexibility to the lid member 30.

A thread (fiber) thickness, a weaving method, a thickness or the like of the fiber base material are selected so as to satisfy required fire resistance.

For example, glass fiber, silica fiber, alumina fiber, alumina-silica-based fiber, carbon-based fiber, calcia fiber, magnesia fiber, titania fiber, zirconia fiber, boria fiber, and $Fe_2O_3$ fiber can be preferably used as a material of the fiber base material in the above composite material.

For example, nitrile rubber, silicone rubber, chloroprene rubber, butyl rubber, fluororubber, fluorosilicone rubber, natural rubber, ethylene-propylene rubber, acryl rubber, urethane rubber, and chlorosulfonated polyethylene rubber can be preferably used as the rubber-based material in the above composite material. Most of these rubber-based materials endure heat of 100° C. or more. Thus, if fire extinction is smoothly performed without exposing the materials to a fire, the shape and the flexibility of the materials are maintained.

For example, each of the nozzle devices 20 is assembled as described below.

First, the nozzle 21 is fixed to the fire extinguishing pipe 17.

Also, the pan 22 is fixed to the back side of the liner 131 with the bolts 251 and the nuts 252.

The liner 131 is then attached to the wall and the ceiling of the cargo hold 12. At this time, the nozzle 21 is passed into the insertion hole 23 of the pan 22.

Subsequently, the lid member 30 is fitted to the nozzle 21 and the pan 22 to close the gap S between the nozzle 21 and the pan 22.

At this time, the nozzle 21 is inserted into the holding hole 310 of the lid member 30. Since an inner diameter of the holding hole 310 is set to be slightly smaller than the outer diameter of the nozzle 21, the lid member 30 is expanded by the nozzle 21. The lid member 30 is thereby pressed against the outer periphery of the nozzle 21 by an elastic force of the rubber-based material contained in the lid member 30. Therefore, the nozzle 21 is held on the lid member 30 by a frictional force between the outer periphery of the nozzle 21 and the inner periphery of the holding hole 310.

When the nozzle 21 is inserted into the holding hole 310, the lid member 30 is positioned with respect to the nozzle 21 and the pan 22. The retainer 323 is then overlapped on the flange portion 32, and the lid member 30 is fastened to the pan 22 with the bolts 321 and the nuts 322. Accordingly, the flange portion 32 of the lid member 30 is pressed against the inner side of the pan body 24.

Even when the nozzle 21 and the pan 22 are slightly displaced from prescribed positions, the displacement is absorbed by the flexibility of the lid member 30. Thus, the nozzle 21 and the pan 22 can be easily attached via the lid member 30.

In the present embodiment, the lid member 30 is arranged on the inner side of the pan 22. Thus, after the liner 131 is attached to the wall and the ceiling, the lid member 30 can be fitted to the nozzle 21 and the pan 22 as described above.

Accordingly, the lid member 30 can be easily positioned and fitted to the nozzle 21 projecting from the insertion hole 23 of the pan 22.

On the other hand, in the present embodiment, the lid member 30 may be previously fitted to the pan 22 before attaching the liner 131, and the lid member 30 may be fitted to the nozzle 21 at the time of attaching the liner 131.

If the lid member is arranged on the outer side of the pan 22, it is necessary to fit the lid member to the pan 22 before attaching the liner 131 or after temporarily removing the liner 131. However, in the present embodiment, an assembling procedure is not limited.

When the nozzle device 20 is assembled as described above, the lid member 30 comes into close contact with the nozzle 21 and the pan 22. Thus, the gap S between the nozzle 21 and the pan 22 is hermetically closed (sealed).

The fire extinguishing system 10 of the present embodiment is automatically activated when the outbreak of a fire in the cargo hold 12 is detected by a fire detection system (not shown).

The fire extinguishing system 10 first opens a valve of the high-pressure tank 16A, and rapidly supplies the fire extinguishing agent to the respective nozzle devices 20 through the fire extinguishing pipe 17. Subsequently, the fire extinguishing system 10 opens a valve of the low-pressure tank 16B, and continues to supply the fire extinguishing agent to the respective nozzle devices 20.

Since the gap S is closed by the lid member 30, the fire extinguishing agent injected from the nozzle 21 of the nozzle device 20 is kept in the cargo hold 12 without leaking from the gap S. Thus, the density of the fire extinguishing agent in the cargo hold 12 is rapidly increased, and a combustion reaction is inhibited by the fire extinguishing agent, so that the fire is extinguished.

Even if the fire reaches or approaches the lid member 30, and the rubber-based material contained in the lid member 30 is melted, the fiber base material exists at a position corresponding to the gap S. The fiber base material prevents gas from coming into and out of the gap S. Thus, the fire extinguishing agent can be kept in the cargo hold 12 until the density reaches a density required for fire extinction. Also, the fiber base material also contributes to prevention of the fire breakthrough from the gap S to the back side of the liner 131.

In the present embodiment, the fiber base material is arranged thick within the lip portion 31, so that the gap S can be substantially closed in view of ensuring air tightness, and preventing a fire breakout.

By the way, an explosive may be brought into the cargo hold 12 as cargo. When the explosive explodes, a pressure from a blast is applied to the liner 131.

Here, it is assumed that the nozzle 21 and the pan 22 are fixed with a bolt, or integrally formed to be rigidly coupled together. In this case, relative displacement between the nozzle 21 and the pan 22 is not allowed, so that the pressure applied to the liner 131 is input to the nozzle 21 as an excessive load via the pan 22 fixed to the liner 131.

Thus, a fire extinguishing function may be lost with the nozzle 21 damaged, or the fire extinguishing pipe 17 broken. To avoid the loss of the fire extinguishing function, the nozzle 21 and the pan 22 fixed to the liner 131 are not rigidly coupled together in the present embodiment. The nozzle 21 and the pan 22 are attached to each other so as to allow relative displacement.

Here, the lid member 30 interposed between the nozzle 21 and the pan 22 is fixed to the pan 22, and holds the nozzle 21 inserted into the holding hole 310. When a load exceeding the frictional force between the outer periphery of the nozzle 21 and the inner periphery of the holding hole 310 is applied, the lid member 30 is displaced in an axial direction of the nozzle 21 with respect to the nozzle 21. Accordingly, the relative displacement between the pan 22 and the nozzle 21 can be ensured.

In the present embodiment, the pan 22 and the nozzle 21 are not rigidly coupled together, but are separated from each other, and the lid member 30 is fixed to the pan 22 as described above.

Therefore, the liner 131, the pan 22, and the lid member 30 are displaced with respect to the nozzle 21 from the inner side to the outer side of the liner 131 by the pressure from the blast. Thus, the excessive load is not input to the nozzle 21.

In accordance with the present embodiment, when the pressure from the explosion is applied to the liner 131, the excessive load is not input to the nozzle 21 via the liner 131. Thus, the nozzle 21, the fire extinguishing pipe 17 connected to the nozzle 21 or the like are not damaged, and the fire extinguishing function of the fire extinguishing system 10 can be secured even after the explosion.

Therefore, a fire that could occur after the explosion can be effectively handled.

In the present embodiment, the lid member 30 is fixed to the pan 22, and the pan 22 is displaced with respect to the nozzle 21 by the load exceeding the frictional force between the lid member 30 and the nozzle 21 as described above.

Because of the configuration, even when the lid member 30 is not provided with a large displacement amount, a relative displacement amount between the pan 22 and the nozzle 21 can be ensured. Therefore, the lid member can be downsized as compared to a case in which, for example, the lid member is formed in a bellows shape. Consequently, the weight of the nozzle device 20 can be reduced.

Figure 4:
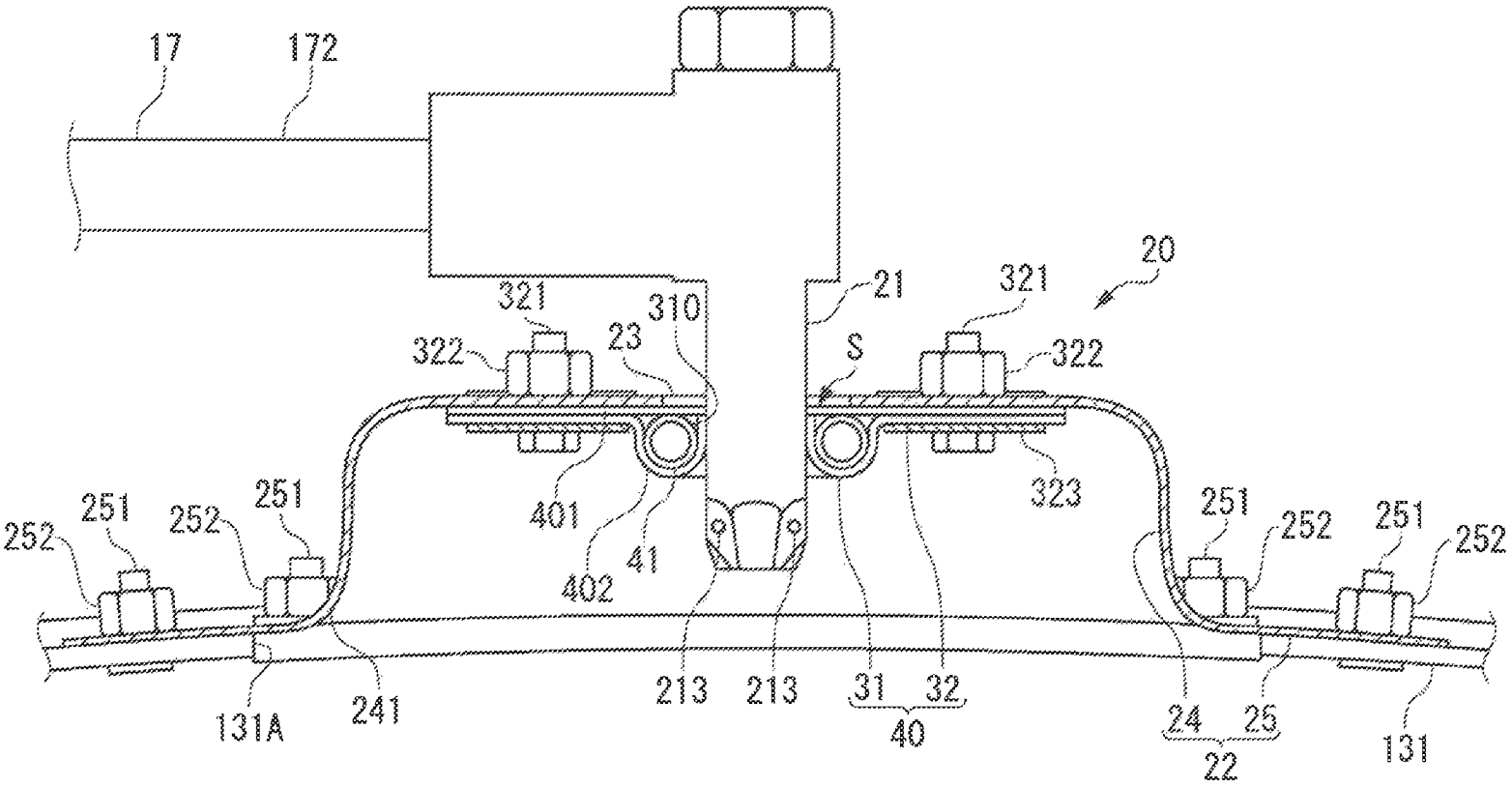
FIG. 4 is a sectional view illustrating a nozzle device according to another embodiment where a spring is incorporated in a lid member.

Next, an embodiment of the lid member applicable to the above nozzle device 20 is described by reference to FIG. 4.

Figure 5:
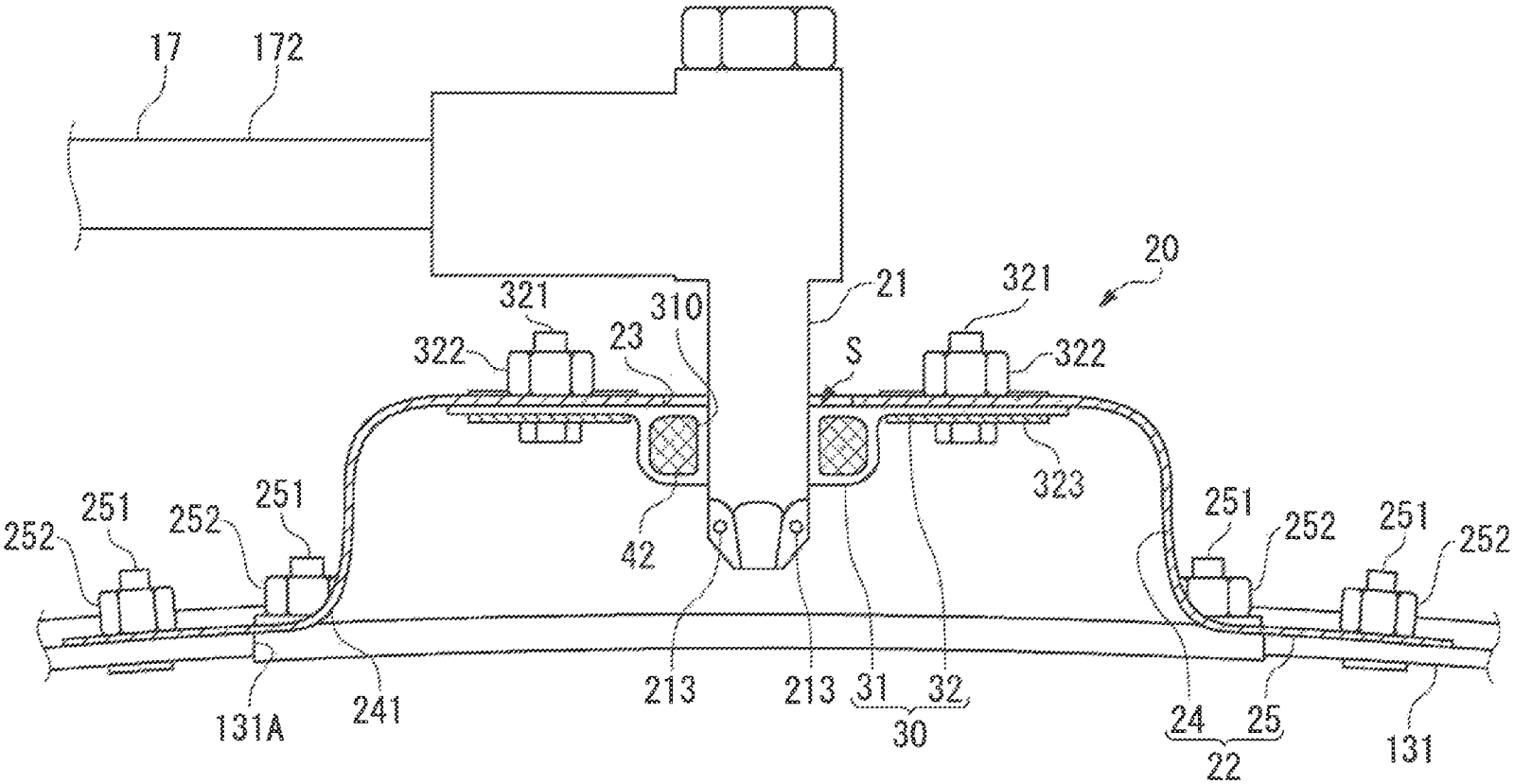
FIG. 5 is a sectional view illustrating a nozzle device according to another embodiment where a mesh is incorporated in a lid member.

The same components as the components described in the above embodiment are assigned the same reference numerals. The same applies to FIG. 5.

A lid member 40 includes the lip portion 31 and the flange portion 32. A spring 41 formed of a material having predetermined fire resistance is incorporated in the lip portion 31.

The lid member 40 can be formed similarly to the lid member 30 of the above embodiment except that the spring 41 is incorporated in the lip portion 31. That is, the lid member 40 can be formed by using a composite material obtained by impregnating a rubber-based material into a fiber base material that is formed minutely from fiber of glass, silica, alumina or the like.

The spring 41 is a coil spring. While the spring 41 linearly extends by itself, the spring 41 is arranged within the lip portion 31 over the entire periphery of the lip portion 31 in a state deflected in a ring shape. The spring 41 is arranged in a hollow portion formed in the lip portion 31.

The lid member 40 of the present embodiment includes two fire-proof clothes (formed of a fiber base material) 401 and 402 with the spring 41 sandwiched therebetween. The fire-proof cloth 401 is arranged flat along the flange portion 32. The fire-proof cloth 402 is arranged so as to be curved along the spring 41. The lid member 40 is formed by rubber-coating the fire-proof clothes 401 and 402.

The spring 41 is formed along the outer periphery of the nozzle 21 within the lip portion 31, and is expanded radially by the nozzle 21 inserted into the holding hole 310. The spring 41 thereby presses the outer periphery of the nozzle 21 via the composite material by an elastic force. The surface of the composite material and the outer periphery of the nozzle 21 come into close contact by the elastic force of the spring 41 and the elastic force of the rubber-based material.

The spring 41 is formed of a metal material or the like having higher fire resistance than the rubber-based material. For example, an alloy material containing iron (typically stainless steel), an alloy material containing nickel, an alloy material containing iron and nickel, and an alloy material containing nickel, iron, and chromium can be preferably used as the metal material.

It is assumed that the lid member 40 is increased to a very high temperature by the heat of a fire or when directly exposed to the fire, and the rubber-based material contained in the lid member 40 loses its flexibility.

Even in this case, the spring 41 maintains its elastic force. Thus, the lid member 40 is sufficiently pressed against the outer periphery of the nozzle 21.

Therefore, the sealing function of the lid member 40 is secured. Thus, the density of the fire extinguishing agent in the cargo hold 12 is rapidly increased, and the fire can be extinguished in an early stage.

Moreover, even when the rubber-based material is melted, the fire breakthrough from the gap S to the back side of the liner 131 can be prevented by the remaining fiber base material and the spring 41.

The spring 41 is desired to be located at a position at least corresponding to the gap S in the lid member 40 so as to press the lid member 40 against the outer periphery of the nozzle 21, and prevent a fire breakout as described above.

Instead of the above spring 41, a mesh 42 (FIG. 5) formed of a material having predetermined fire resistance may be also incorporated in the lip portion 31 of the lid member 40.

The mesh 42 is formed minutely in the form of a ring-shaped or C-shaped tube or pad from a fine wire material. The mesh 42 has flexibility. The mesh 42 is arranged along the outer periphery of the nozzle 21 within the lip portion 31, and is expanded radially by the nozzle 21 inserted into the holding hole 310.

The mesh 42 is formed of a metal material or a ceramic material having higher fire resistance than the rubber-based material. For example, an alloy material containing iron (typically stainless steel), an alloy material containing nickel, an alloy material containing iron and nickel, and an alloy material containing nickel, iron, and chromium can be preferably used as the metal material.

Even when the flexibility of the rubber-based material contained in the lid member 40 is lost by the heat of a fire or when the lid member 40 is directly exposed to the fire, the sealing function of the lid member 40 can be secured by the elastic force of the mesh 42. The fire breakthrough from the gap S to the back side of the liner 131 can be also prevented by the fiber base material and the mesh 42.

The constitutions described in the aforementioned embodiments may be also freely selected or appropriately changed into other constitutions without departing from the scope of the present invention.

The lid member in the present invention may not have flexibility. For example, a lid member obtained by filling the gap S with a paste containing ceramic powder and curing the paste may be used as the lid member. A surface of the lid member may be also coated by using a material having a small friction coefficient, such as fluorine-based resin (e.g., Teflon (registered mark)), so as to facilitate sliding between the nozzle installation section or the nozzle and the lid member.

The pan 22 may be also formed integrally with the liner 131. In this case, the nozzle 21 is passed through the insertion hole 23 formed in the pan (the nozzle installation section) that is one portion of the liner 131.

As long as the gap formed between the outer periphery of the nozzle and the nozzle installation section (the fixture such as the pan) is closed, various forms can be employed for the lid member in the present invention.

The lid member may be configured to close the gap from the outer side of the pan 22. The lid member may be also inserted into the gap.

The lid member in the present invention may be also configured to be fixed to the nozzle 21, not the pan 22, and pressed against the inner periphery of the insertion hole 23 of the pan 22. In this case, the pan 22 is relatively displaced with respect to the lid member and the nozzle 21 by a load exceeding a frictional force between the pan 22 and the lid member. In this case, the same effects as those of the above embodiment can be also obtained.

In the present invention, the lid member may be formed in a bellows shape, and relative displacement between the nozzle 21 and the pan 22 may be absorbed by a displacement amount by the bellows.

The present invention can be applied to a fire extinguishing system for a cargo hold that is arranged below a cabin of an aircraft.

The present invention can be also applied to fire extinguishing systems for various compartments provided in an aircraft, such as an engine compartment that accommodates an engine of the aircraft, and an auxiliary power unit compartment that accommodates an auxiliary power unit, in addition to the cargo holds of the aircraft.

Furthermore, the present invention is not limited to the aircraft, and can be also applied to fire extinguishing systems for various compartments in, for example, ships, trains, and buildings.

What is claimed is:

1. A fire extinguishing system of an aircraft comprising a nozzle device that is provided on an installation member forming a compartment of the aircraft, wherein the nozzle device includes:

a nozzle that is passed into an insertion hole formed in a nozzle installation section, said nozzle installation section provided on the installation member, and said nozzle discharges a fire extinguishing agent supplied from a supply source into the compartment; and a lid member that closes a gap between the nozzle and the nozzle installation section, wherein the gap is a continuous gap provided along an entire circumference of the nozzle, said gap being provided by said insertion hole being formed with an inner diameter that is larger than an outer diameter of said nozzle; and wherein the nozzle is not rigidly coupled with the nozzle installation section.

2. The fire extinguishing system of an aircraft according to claim 1, wherein the nozzle is attached to the nozzle installation section so as to allow relative displacement therebetween.

3. The fire extinguishing system of an aircraft according to claim 1, wherein the gap exists between an outer periphery of the nozzle and an inner periphery of the insertion hole.

4. The fire extinguishing system of an aircraft according to claim 1, wherein the lid member is fixed to the nozzle installation section, and the nozzle installation section is displaced with respect to the nozzle by a load exceeding a frictional force between the nozzle and the lid member.

5. The fire extinguishing system of an aircraft according to claim 1, wherein the lid member is fixed to the nozzle.

6. The fire extinguishing system of an aircraft according to claim 1, wherein the lid member has flexibility.

7. The fire extinguishing system of an aircraft according to claim 6, wherein the lid member includes a lip portion having a holding hole into which the nozzle is inserted, and a flange portion that is fixed around the insertion hole.

8. A fire extinguishing system of an aircraft, comprising a nozzle device that is provided on an installation member forming a compartment of the aircraft, wherein the nozzle device includes:

a nozzle that is passed into an insertion hole formed in a nozzle installation section provided on the installation member, and discharges a fire extinguishing agent supplied from a supply source into the compartment; and a lid member that closes a gap between the nozzle and the nozzle installation section, wherein the lid member has flexibility, and wherein the lid member includes a lip portion having a holding hole into which the nozzle is inserted, and a flange portion that is fixed around the insertion hole wherein the lip portion is formed thicker than the flange portion.

9. The fire extinguishing system of an aircraft according to claim 6, wherein the lid member is formed of a composite material containing a rubber-based material having flexibility, and a fiber base material having higher fire resistance than the rubber-based material.

10. The fire extinguishing system of an aircraft according to claim 7, wherein the lid member is formed of a composite material containing a rubber-based material having flexibility, and a fiber base material having higher fire resistance than the rubber-based material.

11. A fire extinguishing system of an aircraft, comprising a nozzle device that is provided on an installation member forming a compartment of the aircraft, wherein the nozzle device includes:

a nozzle that is passed into an insertion hole formed in a nozzle installation section provided on the installation member, and discharges a fire extinguishing agent supplied from a supply source into the compartment; and a lid member that closes a gap between the nozzle and the nozzle installation section, wherein the lid member has flexibility, wherein the lid member is formed of a material containing a rubber-based material having flexibility, and incorporates a backup member having flexibility that is formed of a material having higher fire resistance than the rubber-based material.

12. The fire extinguishing system of an aircraft according to claim 11, wherein the backup member is formed in a ring shape or a C shape along an outer periphery of the nozzle.

13. The fire extinguishing system of an aircraft according to claim 11, wherein the backup member is arranged at a position at least corresponding to the gap.

14. The fire extinguishing system of an aircraft according to claim 11, wherein the backup member is a spring formed of a metal material.

15. The fire extinguishing system of an aircraft according to claim 11, wherein the backup member is a mesh formed of a metal material or a ceramic material.

16. The fire extinguishing system of an aircraft according to claim 1, wherein the nozzle installation section is a fixture that is integrated with the installation member.

17. An aircraft comprising the fire extinguishing system of an aircraft according to claim 1.

18. The aircraft according to claim 17, wherein the compartment is a cargo hold that accommodates cargo.

19. The fire extinguishing system of an aircraft according to claim 1, wherein the nozzle is not rigidly coupled with the nozzle installation section so as to allow relative movement of the nozzle in all directions.

20. The fire extinguishing system of an aircraft according to claim 1, wherein the nozzle installation section has a thickness, and wherein the continuous gap is provided over the entire thickness of the nozzle installation section.

* * * * *